US010618159B2

(12) United States Patent
Maruzzo et al.

(10) Patent No.: US 10,618,159 B2
(45) Date of Patent: Apr. 14, 2020

(54) TOOL CHEST ORGANIZATION BOARD

(71) Applicant: 1046959 Ontario Inc., Burlington (CA)

(72) Inventors: Walter Maruzzo, Burlington (CA); Chris Racine, Burlington (CA)

(73) Assignee: 1046959 Ontario Inc., Burlington (CA)

( * ) Notice: Subject to any disclaimer, the term of this patent is extended or adjusted under 35 U.S.C. 154(b) by 0 days.

(21) Appl. No.: 15/608,442

(22) Filed: May 30, 2017

(65) Prior Publication Data

US 2017/0341218 A1 Nov. 30, 2017

Related U.S. Application Data

(60) Provisional application No. 62/343,062, filed on May 30, 2016.

(51) Int. Cl.

| | |
|---|---|
| ***B25H 3/04*** | (2006.01) |
| ***A47F 7/00*** | (2006.01) |
| ***A47B 88/988*** | (2017.01) |
| ***A47B 88/994*** | (2017.01) |

(52) U.S. Cl.
CPC ..... *B25H 3/04* (2013.01); *A47B 88/988* (2017.01); *A47B 88/994* (2017.01)

(58) Field of Classification Search
CPC .... B25H 3/04; B25H 3/02; A61L 2/26; A61B 50/33
See application file for complete search history.

(56) References Cited

U.S. PATENT DOCUMENTS 4,135,868 A * 1/1979 Schainholz ..... A61L 2/26 206/438
4,798,292 A * 1/1989 Hauze ..... A61L 2/26 206/210
4,852,930 A * 8/1989 Agee ..... A47F 5/0807 206/373
5,346,075 A * 9/1994 Nichols ..... A61L 2/26 206/363
5,433,930 A * 7/1995 Taschner ..... A61L 2/26 206/370
5,681,539 A * 10/1997 Riley ..... A61L 2/26 206/370
5,725,096 A * 3/1998 Winnard ..... A45C 13/02 206/350
5,827,487 A * 10/1998 Holmes ..... A61L 2/26 206/370
6,048,503 A * 4/2000 Riley ..... A61L 2/26 206/370

(Continued)

*Primary Examiner* — Kimberley S Wright
(74) *Attorney, Agent, or Firm* — Fitch, Even, Tabin & Flannery LLP

(57) ABSTRACT

A system for organizing tools including a board and one or more holders. The board has a plurality of holes formed on the top surface, the plurality of holes are arranged in rows and columns at predetermined intervals, where the holes in each row and column are aligned with holes in adjacent rows and columns. The one or more holders each have a top portion and a bottom portion, where the top portion secures one end of a tool and the bottom portion has a hole dimensioned to align with the plurality of holes on the board. One or more screws secure the one or more holders to the board, where the one or more screws pass through the hole on the holder and into one of the plurality of holes on the board.

7 Claims, 19 Drawing Sheets

(56) References Cited

U.S. PATENT DOCUMENTS 6,244,447 B1 * 6/2001 Frieze ..... A61L 2/07 206/370
6,436,357 B1 * 8/2002 Frieze ..... A61L 2/26 206/263
6,575,313 B1 * 6/2003 Chen ..... B25H 3/02 211/70.6
6,783,004 B1 * 8/2004 Rinner ..... A61B 17/8875 206/368
6,969,498 B1 * 11/2005 Riley ..... A61L 2/26 206/363
6,991,414 B1 * 1/2006 Mensah ..... F16B 37/145 411/231
7,051,884 B2 * 5/2006 Dick ..... A47F 5/0815 211/70.6
7,073,672 B2 * 7/2006 Sholem ..... B25H 3/04 211/70.6
7,246,704 B2 * 7/2007 Brunson ..... B25H 3/003 206/372
7,341,148 B2 * 3/2008 Bettenhausen ..... A61L 2/18 206/370
7,424,958 B1 * 9/2008 Eley ..... B25H 3/04 211/70.6
7,601,312 B2 * 10/2009 Riley ..... A61B 50/33 248/309.1
7,748,529 B2 * 7/2010 Foreman ..... A61L 2/26 206/370
7,861,860 B2 * 1/2011 Bettenhausen ..... A61L 2/18 206/370
8,267,246 B2 * 9/2012 Bettenhausen ..... A61B 50/34 206/363
8,371,444 B1 * 2/2013 Huang ..... B25H 3/003 206/373
8,505,720 B2 * 8/2013 Huang ..... B25H 3/00 206/349
9,115,969 B2 * 8/2015 Goodwin ..... F42B 39/02
9,193,063 B2 * 11/2015 Huang ..... B25H 3/04
9,610,126 B2 * 4/2017 Griffin ..... A61B 50/30
9,827,663 B2 * 11/2017 Kao ..... B25H 3/04
9,833,529 B2 * 12/2017 Tipton ..... A61L 2/26
2002/0023855 A1 * 2/2002 Cho ..... A45C 13/02 206/373
2004/0256335 A1 * 12/2004 Sholem ..... B25H 3/04 211/70.6
2005/0016943 A1 * 1/2005 Dick ..... A47F 5/0815 211/70.6
2006/0070900 A1 * 4/2006 Brunson ..... B25H 3/003 206/373
2006/0213794 A1 * 9/2006 Foreman ..... A61L 2/26 206/370
2006/0266666 A1 * 11/2006 Bettenhausen ..... A61L 2/18 206/370
2007/0009408 A1 * 1/2007 Riley ..... A61L 2/26 422/300
2008/0149512 A1 * 6/2008 Dane ..... A61L 2/26 206/370
2009/0146032 A1 * 6/2009 Bettenhausen ..... A61B 50/34 248/220.31
2013/0118938 A1 * 5/2013 Huang ..... B25H 3/00 206/372
2014/0083886 A1 * 3/2014 Winterrowd ..... A61B 50/34 206/370
2015/0151017 A1 * 6/2015 Tipton ..... A61L 2/26 422/310
2015/0251311 A1 * 9/2015 Huang ..... B25H 3/04 211/70.6
2017/0027411 A1 * 2/2017 Gobl ..... A47B 55/00
2017/0312910 A1 * 11/2017 Kao ..... B25H 3/04

* cited by examiner

TOOL CHEST ORGANIZATION BOARD

CROSS-REFERENCE TO RELATED APPLICATION

This application claims the benefit of U.S. Provisional Application No. 62/343,062, filed May 30, 2016, which is hereby incorporated by reference in its entirety.

FIELD OF THE INVENTION

This invention relates generally to tool organization and more particularly to a tool chest organization board and system.

BACKGROUND OF THE INVENTION

Conventional systems for organizing tools include wall-mounted boards for storing tools as well as organizers for use in tool drawers. Some conventional tool drawer organizers include a board having multiple holes and separate pegs that may inserted into the holes. In use, the pegs are inserted into the board to hold tools that are placed onto the board.

With conventional systems for tool organization, the pegs used limit movement of the tools on the board, but do not provide custom securement to the board based on the type of tools. As well, conventional tool organization boards do not provide an efficient use of space to increase the number of tools held onto the board.

SUMMARY OF THE INVENTION

The present application provides a tool chest organization board. In use, the board lies flat in the bottom of a tool box or drawer. The board has a pattern of closely spaced holes. In association with the board are a variety of tool specific holders which have holes that are dimensioned to align with the holes in the board to enable a separate fastener such as a thread-forming screw to be inserted through the holder and into the board. The board is generally sized to correspond to the dimensions of a tool box drawer. The organization board enables tools, which would ordinarily lie flat in the tool box drawer and move around when the drawers open and close, to be arranged in an organized manner so that each tool is readily visible and readily accessible to a mechanic or other tradesperson.

According to the present application, there is provided a system for organizing tools, the system comprising: a board having a plurality of holes formed on the top surface, the plurality of holes being arranged in rows and columns at predetermined intervals, wherein the holes in each row and column are aligned with holes in adjacent rows and columns; one or more holders having a bottom portion, the bottom portion of each holder having a hole dimensioned to align with the plurality of holes on the board; and one or more fasteners for securing the one or more holders to the board, wherein the one or more fasteners pass through the hole on the holder and into one of the plurality of holes on the board.

As well, the present application provides a tool holder for use with a tool organizational board having a plurality of holes formed on the top surface, the tool holder comprising: a bottom portion having a hole dimensioned to align with the plurality of holes on the board; and a top portion for receiving an end portion of a tool for securing the tool to the board.

Also, the present application provides a tool organization board for use with one or more tool holders, the board comprising: a plurality of holes formed within the top surface of the board, the plurality of holes being arranged in rows and columns at predetermined intervals, wherein the holes in each row and column are aligned with holes in adjacent rows and columns.

BRIEF DESCRIPTION OF THE DRAWINGS

Embodiments of the invention are described below with reference to the following drawings.

DETAILED DESCRIPTION

Figure 1:
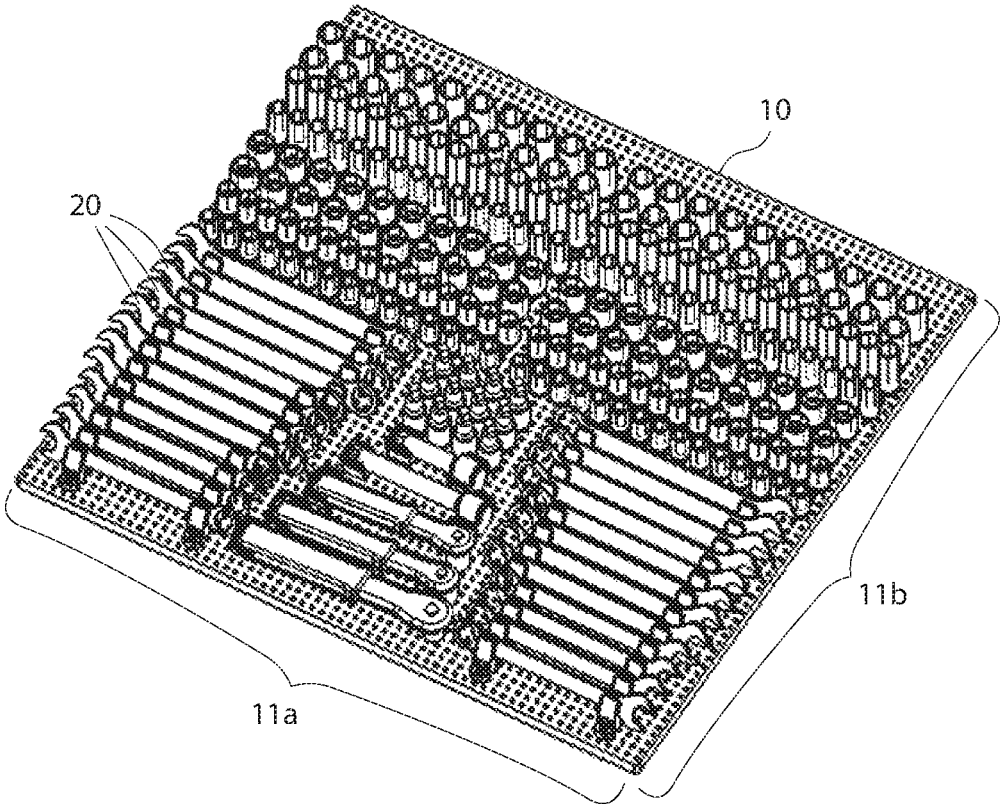
FIG. 1 is a perspective view of a tool organization board, according to an embodiment of the present invention.
Figure 2:
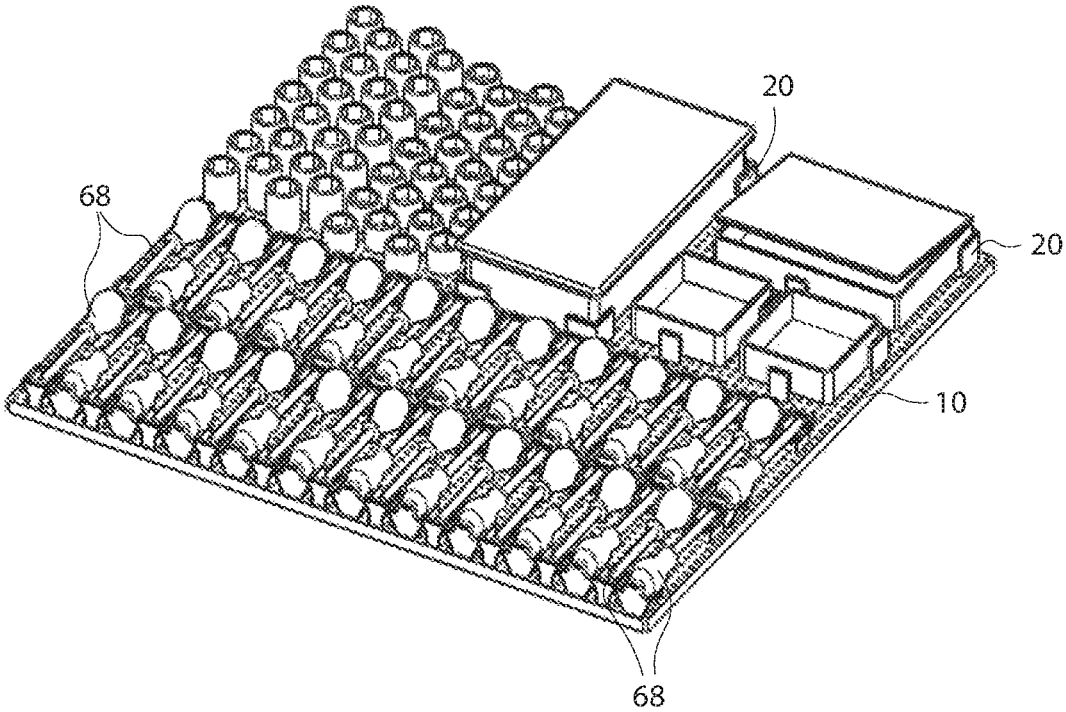
FIG. 2 is a perspective view of the tool organization board, according to an another embodiment of the present invention.
Figure 3A:
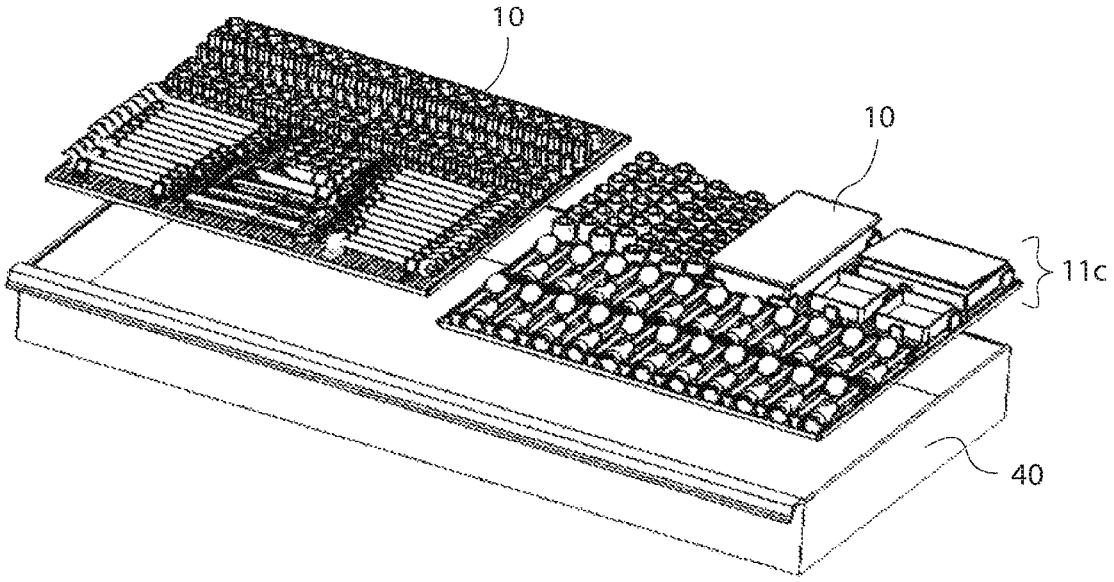
FIG. 3A is a perspective view of the tool organization board over a tool drawer, according to an embodiment of the present invention.
Figure 3B:
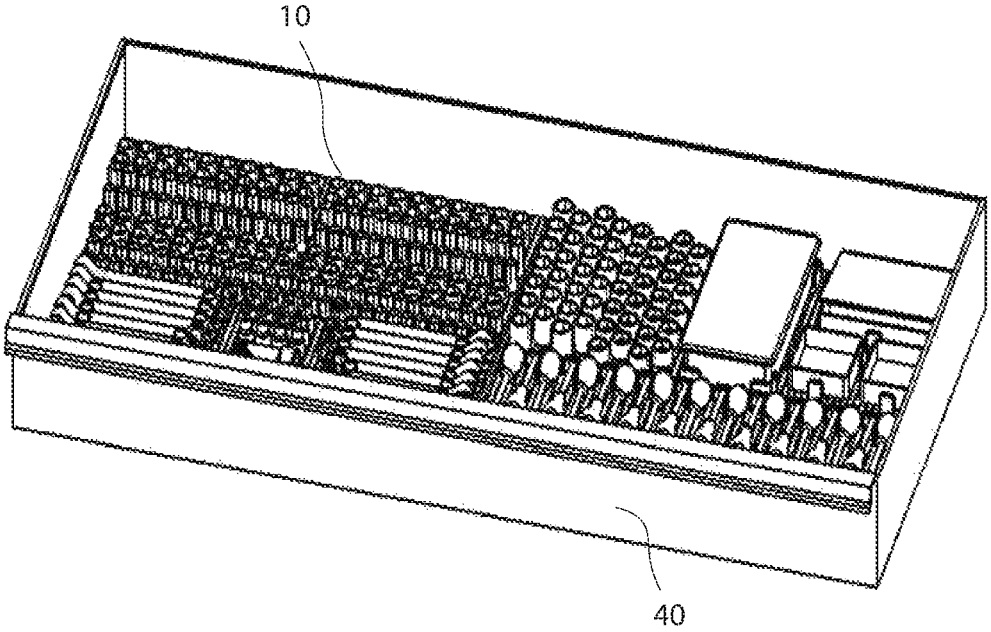
FIG. 3B is a perspective view of the tool organization board lying flat in a tool chest drawer.
Figure 4A:
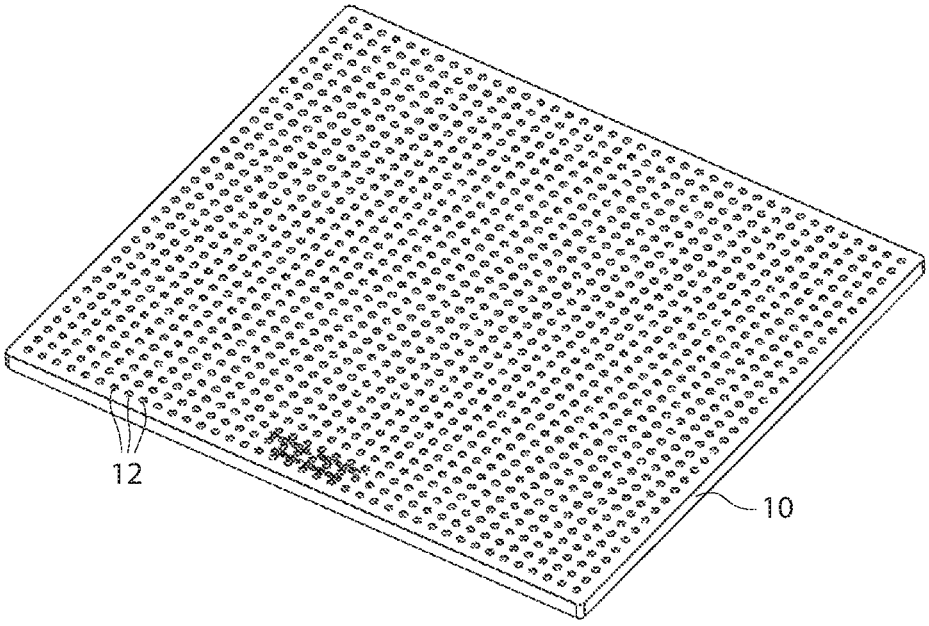
FIG. 4A is a perspective view of the front face of an exemplary tool organization board.
Figure 4B:
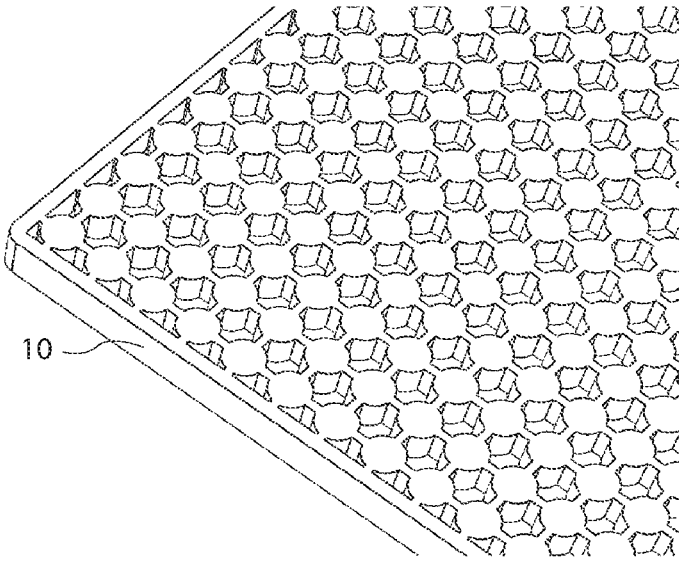
FIG. 4B is a perspective view of the bottom surface of an exemplary tool organization board.

As shown in FIGS. 1 and 2, there is provided a system for organizing tools in a tool chest drawer. The tool grid system includes a board 10 and a plurality of holders 20 for securing tools to the board. The board 10 is of a predetermined size and thickness to fit in within a drawer 40 (FIGS. 3A and 3B) of a tool chest. The size and shape of the board 10 corresponds to the size and shape of the inner dimensions of the tool chest drawer 40. For example, the length 11*a* and width 11*b* of the board 10 would be sufficient to permit the board 10 to be laid flat in the drawer 40, as shown in FIG. 3B. Various sizes of the board 10 are provided to accommodate different sizes of tool chest drawers 40. Also, a board 10 smaller than the size of the tool chest drawer 40 may be used such that it does not occupy the entire space of the tool chest drawer 40. As well, the height 11*c* of the board 10 is less than the available height of the drawer 40, so that there is sufficient clearance to open and close the drawer 40 when tools are positioned onto the board 10. The board 10 has a flat top surface and flat bottom surface and may be made of molded rigid plastic or another hard material. The flat bottom surface of the board 10 may be solid for laying the board flat in a tool chest drawer, as shown in FIG. 3B. Alternatively, it may shelled out as shown in FIG. 4B to reduce the weight of the board.

The board 10 has a plurality of holes 12 formed on the top surface of the board 10 at predetermined intervals. In one embodiment, as shown in FIGS. 1 and 4A, the holes 12 are arranged in rows and columns and are spaced apart at equal distances, providing a grid or array pattern. As well, in this embodiment, the holes 12 in one row or column are aligned with the position of the holes 12 in the adjacent row or column. For example, the holes 12 in a first row or column are not positioned to be offset from the position of the holes 12 in the second adjacent row or column. The holes 12 are closely spaced on the board 12, resulting in more flexibility in the possible arrangements for securing tools to the board 10.

In an embodiment, the holes 12 are for receiving one or more fasteners, for example, screws 14 (as shown in for example, the A series of FIGS. 5-18). In an embodiment, the holes 12 receive one or more thread-forming screws 14. As well, the holes 12 in the board 10 are of a sufficient depth for receiving the one or more screws 14 such that the screws 14 when threadedly engaged in the holes 12 do not pass through the bottom surface of the board 10. The screws 14 have a shape and size corresponding to the shape and size of the holes 12 for threaded engagement into one of the holes 12. The screws 14 have self-forming threads. In an alternative embodiment, the holes 12 may be threaded and the screws 14 may have matching threads.

Figure 5A:
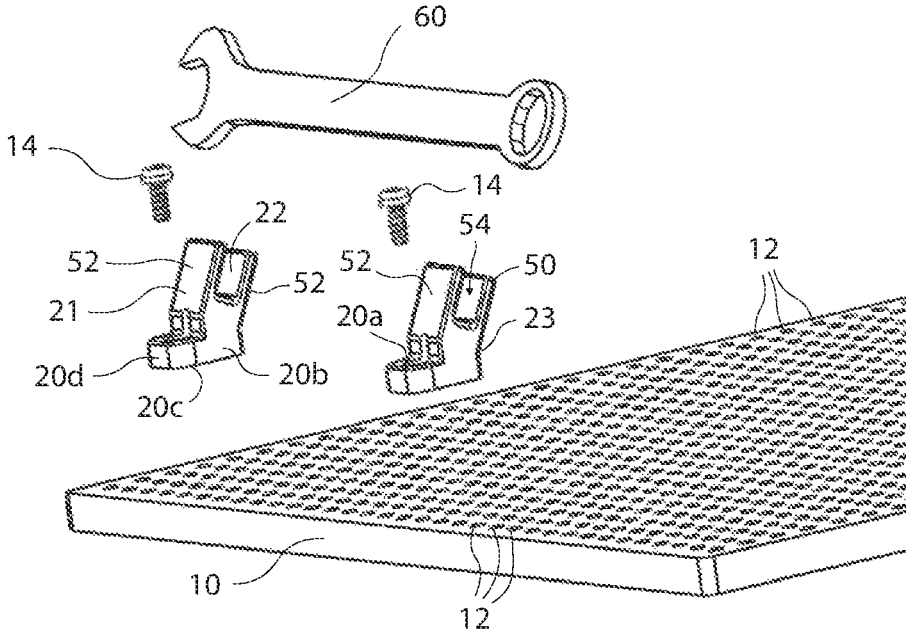
FIG. 5A is an exploded view of part of the tool organization board with exemplary first holders for securing a combination wrench, according to an embodiment of the present invention.
Figure 9A:
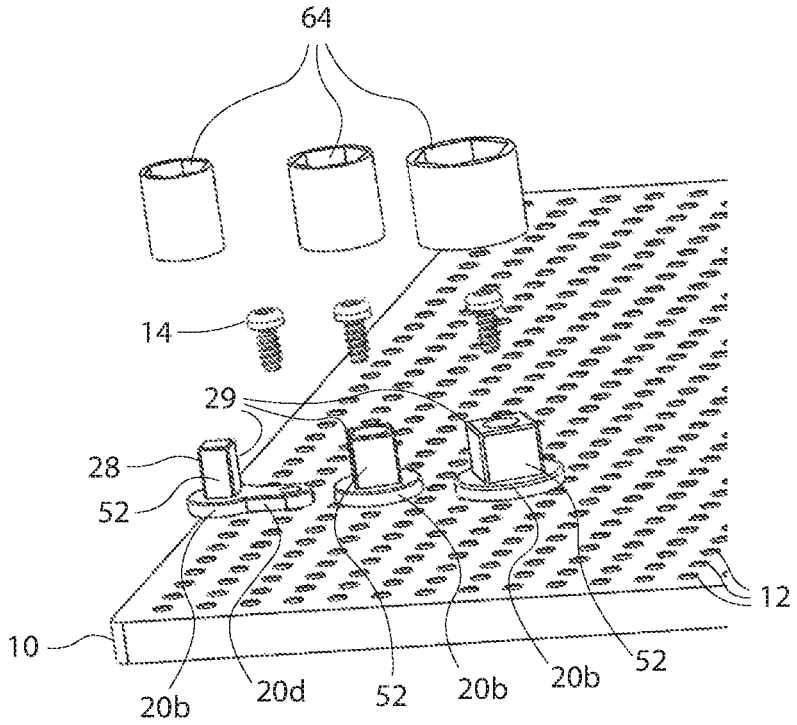
FIG. 9A is an exploded view of part of the tool organization board with exemplary fourth holders for securing a socket, according to an embodiment of the present invention.
Figure 11A:
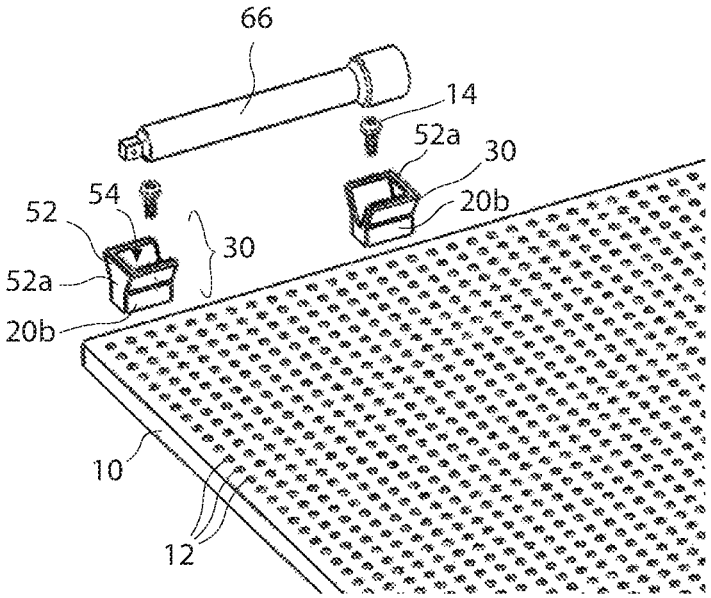
FIG. 11A is an exploded view of part of the tool organization board with exemplary fifth holders for securing an extension bar, according to an embodiment of the present invention.
Figure 13A:
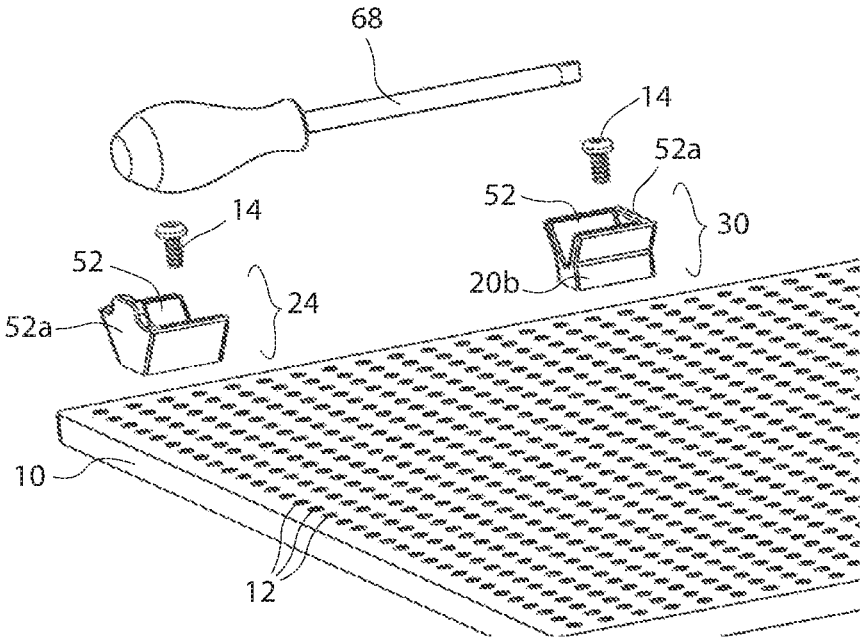
FIG. 13A is an exploded view of part of the tool organization board with exemplary second and fifth holders for securing a screwdriver, according to an embodiment of the present invention.

As shown in FIG. 5A, tools are secured to the board 10 using one or more holders 20. Each of the holders 20 has a bottom portion 20*b* having a flat bottom surface 20*c* for placement onto the board 10 and a hole 20*a* on the bottom portion 20*b* that is dimensioned to align with the plurality of holes 12 on the board 10. Depending on the type of holder 20, the hole 20*a* may be positioned in different areas on the bottom portion 20*b* of the holder 20. For example, as shown in FIGS. 5A, 9A, and 16A the hole 20*a* extends through a lip 20*d* that forms part of the bottom portion 20*b*. In another example, the hole 20*a* is generally centered on the bottom portion 20*b* as shown in, for example, FIGS. 6A, 6C, 7A, 9A, 11A, 13A, and 15A. Alternatively, the hole 20*a* may be offset slightly on the bottom portion 20*b*. For example, rather than being generally centered as shown in FIGS. 11A and 13A among others, the hole 20*a* may be offset or on any part of the bottom portion 20*b*. In use, the plurality of holders 20 are secured to the board 10 by inserting one of the fasteners or, for example, screws 14 through one of the plurality of holders 20 into the board 10. The holders 20 may be made of molded plastic providing a rigid plastic outer body 21. Alternatively, the holders 20 may be made of any other material such as rubber, metal or other suitable materials. The inner portion 22 of the holders 20 which receives the tool may have a surface material, such as polyvinyl chloride (PVC), that provides a grip so that the tool is secured to the holders 20. As shown in FIGS. 1-4, the plurality of holders 20 securely grasp the tools edgewise and endwise to the board 10.

As shown in FIGS. 1-4, the system of the present application orients tools in a preferred position for identification and access. For example, as shown in FIG. 1, combination wrenches 60 are organized by size and the socket wrenches are also aligned by size next to the available attachable sockets in varying sizes. As shown in the FIGS. 1-4, the closely spaced holes 12 provide flexibility in the positioning of the plurality of holders 20, and consequently the tools secured by the holders 20. This, in turn, permits a greater number of tools to be secured to the board 10. The plurality of holders 20 also do not consume significant space on the board, leaving the space on the board 10 available for securing tools. As well, the example tool organization shown in FIGS. 1-4 is easily recognizable. Accordingly, the system accommodates a number of tools and allows customization of the organization of the tools for access. The use of the interchangeable holders 20 by fasteners also permits the board 10 to be rearranged as needed when new or replacement tools are added.

Figure 5B:
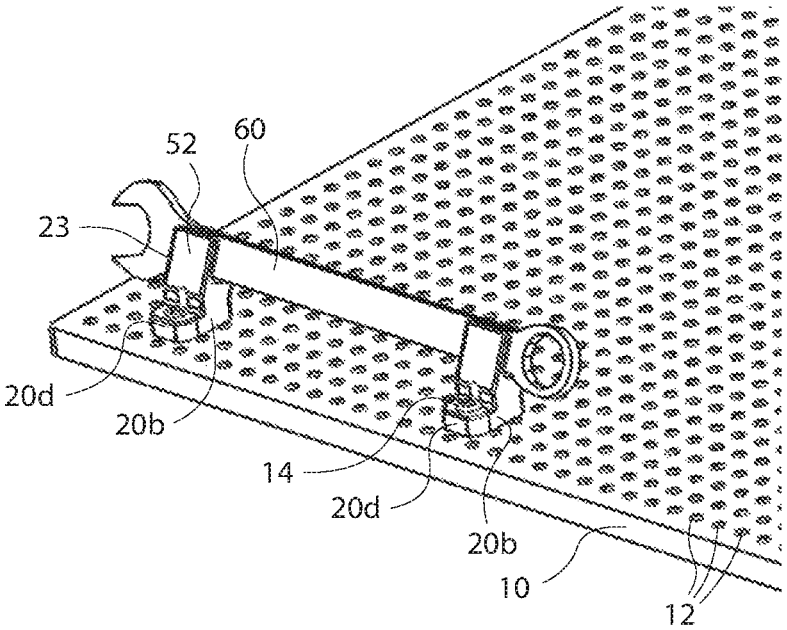
FIG. 5B is a perspective view of the combination wrench secured to the tool organization board with the exemplary first holders of FIG. 5A, according to an embodiment of the present invention.

The plurality of holders 20 includes various shapes and sizes to accommodate different types of tools. These holders 20 may be used alone or in any combination thereof to hold tools and customize the arrangement of the board 10. As shown in FIGS. 5A and 5B, a first holder 23 is provided for receiving combination wrenches 60. In FIGS. 5A and 5B, for example, two of the first holders 23 are used to secure each of the combination wrenches 60. In one embodiment, the first holder 23 has a top portion 50 having two walls 52 extending from the bottom portion 20*b* and a recess 54 between the two walls 52, forming a clamp-like structure for receiving the handle portion of the combination wrench 60. As shown in FIG. 5A, each of the two first holders 23 has a hole 20*a* for receiving a screw 14. The hole 20*a* extends through the lip 20*d* that forms part of the bottom portion 20*b* of the holder 23. FIG. 5B shows the combination wrench 60 secured to the board 10 using the two first holders 23, where the two screws 14 are threadedly engaged through the holes 20*a* of the holder 20 and into two of the holes 12 of the board 10 to secure the two first holders 23 to the board 10. As shown in FIGS. 1-4 and 5B, the combination wrenches 60 may be secured to the board 10 vertically rather than horizontally, providing a more efficient organizational arrangement that provides space on the board 10 for other tools. As well, only two of the first holders 23 are required to achieve the vertical positioning of a combination wrench 60 onto the board 10.

In another embodiment, the first holder 23 may be as shown in FIGS. 6A-6D. In this embodiment, the first holder 23 has a top portion 50 having walls 52 extending from the bottom portion 20*b* and a recess 54 between the walls 52, forming a clamp-like structure for receiving the handle portion of the combination wrench 60. In this embodiment, one of the walls is split so as to effectively provide three walls 52, one of which is facing the other two walls 52 across the recess 54. Additionally, as shown in FIGS. 6A-6D, the hole 20*a* is generally centered in the bottom portion 20*b* as contrasted to the hole 20*a* in the lip 20*d* of the variant holder 23 shown in FIGS. 5A and 5B. This configuration allows the holders 20 to be more closely positioned on the board 10 as no lip extends outwardly from the bottom portion to occupy space on the board 10. Other embodiments are also possible with greater or fewer walls 52 as suitable or a different location of the hole 20*a* and the like. For example, in another embodiment, the first holder 23 may have two walls 52 as earlier described but with a generally centered hole 20*a*. The holders 23 may also be sized or dimensioned to accommodate different tool sizes.

Figure 7A:
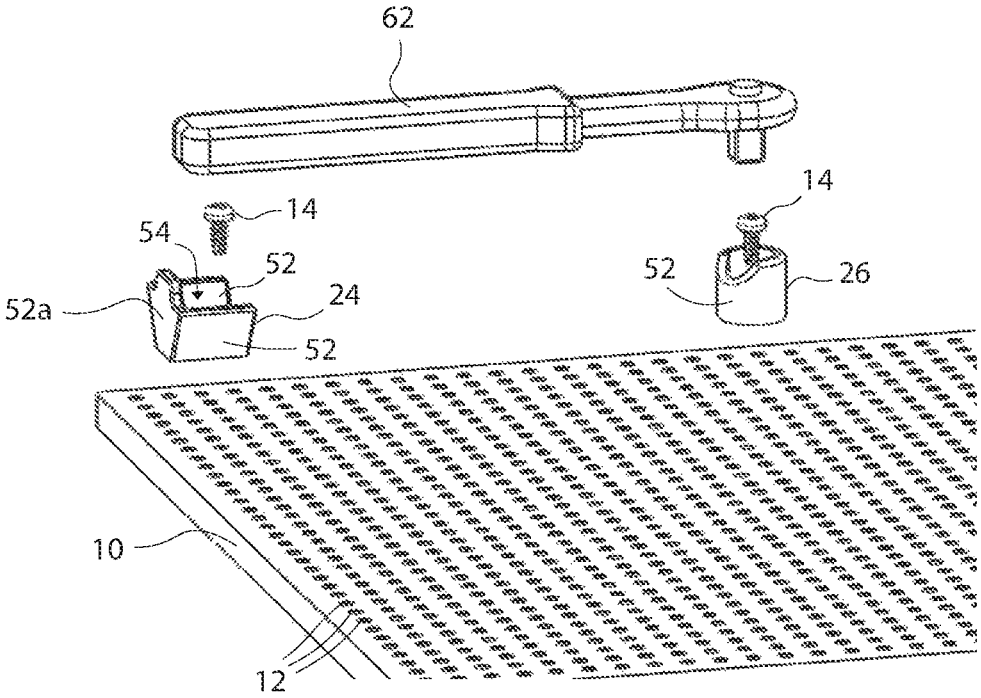
FIG. 7A is an exploded view of part of the tool organization board with exemplary second and third holders for securing a socket wrench, according to an embodiment of the present invention.
Figure 7B:
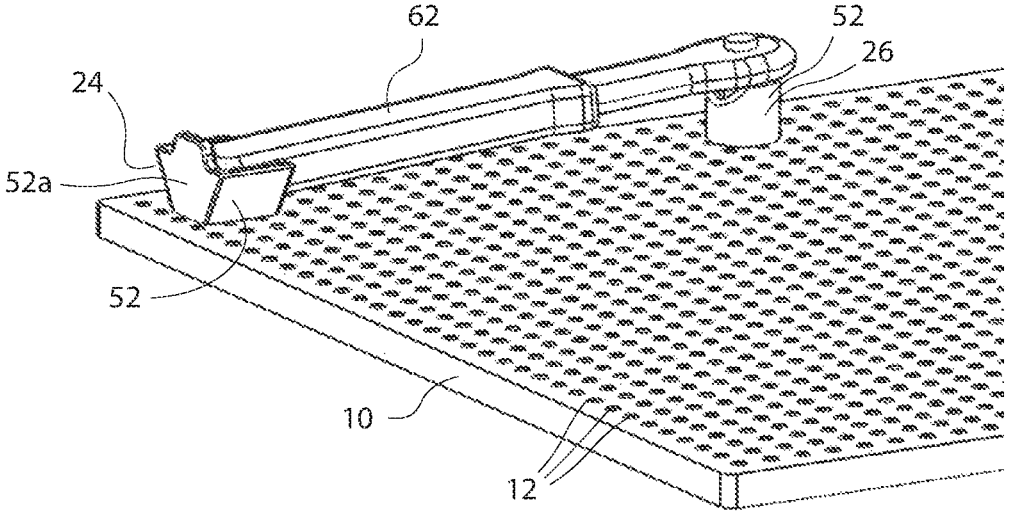
FIG. 7B is a perspective view of the socket wrench secured to the tool organization board with the exemplary second and third holders of FIG. 7A.

As well, as shown in FIGS. 7A and 7B, a second holder 24 and a third holder 26 may be provided for receiving appropriate tools such as socket wrenches 62. As shown in FIG. 1, at a first end, the socket wrench 62 is secured using the second holder 24 having walls 52 extending from the bottom portion 20*b* and a recess 54 for receiving the end handle portion of the socket wrench 62. Also, one of the walls forms a rear wall 52*a* that joins the opposing walls 52. This rear wall 52*a* has a narrower width at the bottom than at its top to accommodate the remaining walls 52 that angle outwardly from the bottom portion 20*b*. This, in turn, permits for a generally V shaped cavity or recess 54 for receiving and securing tools. At the second end, the head of the socket wrench 62 is secured by the exemplary third holder 26. The third holder 26 has a circular shape with a recess 54 in the middle for receiving the drive head of the socket wrench 62. The third holder 26 may have an indentation in the rim 27 for easier removal or placement of tools. As shown in FIG. 7A, both of the second holder 24 and the third holder 26 have a hole 20*a* generally centered in the respective bottom portions 20*b* for receiving a screw 14. However, as mentioned above, this hole placement could be altered. FIG. 7B shows the socket wrench 62 secured to the board 10 using the second holder 24 and the third holder 26, where each of the two screws 14 is threadedly engaged into respective of the plurality of holes 12 of the board 10 to secure the second holder 24 and the third holder 26 to the board 10.

Figure 18A:
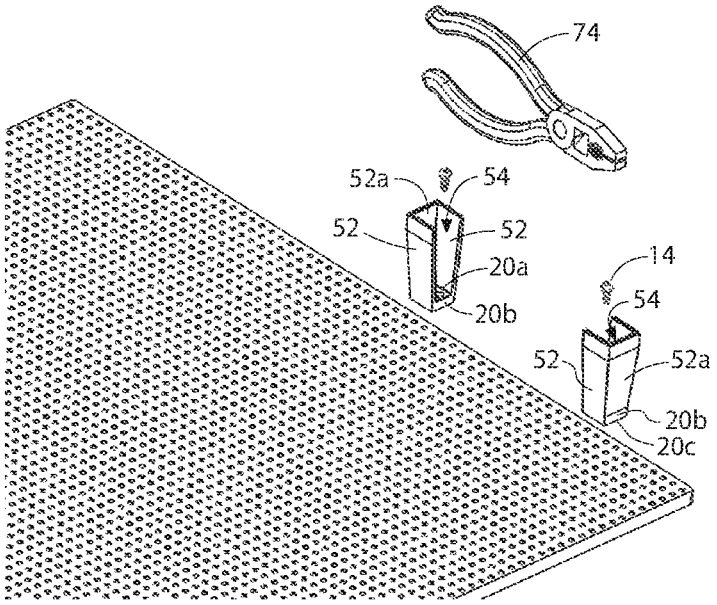
FIG. 18A is an exploded view of part of the tool organization board with exemplary three-wall holders for securing pliers, according to an embodiment of the present invention.
Figure 18B:
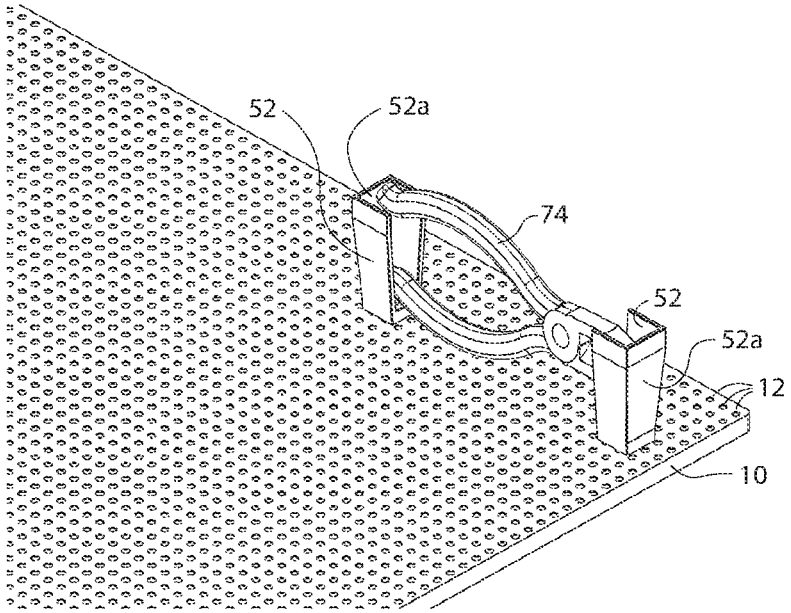
FIG. 18B is a perspective view of the pliers secured to the tool organization board with the exemplary three-wall holders of FIG. 17A, according to an embodiment of the present invention.

An alternative embodiment of the second holder can be viewed on FIGS. 18A and 18B. The walls 52 extending from the bottom portion 20*b* may be angled as described to create a V shaped cavity or recess 54 to accommodate tools with different thicknesses. For example, FIGS. 18A and 18B show the use of the second holder to hold pliers 74. In this variation, the top portion 50 has a flat rim, and the bottom portion 20*b* extends inward from the walls 52 so to create a recess 54. However, as mentioned, the bottom portion 20*b* may extend outward in a lip 20*d* so that the hole 20*a* is located exterior to the walls 52 rather than generally centered within the holder 24 as shown in the accompanying figures.

Figure 6A:
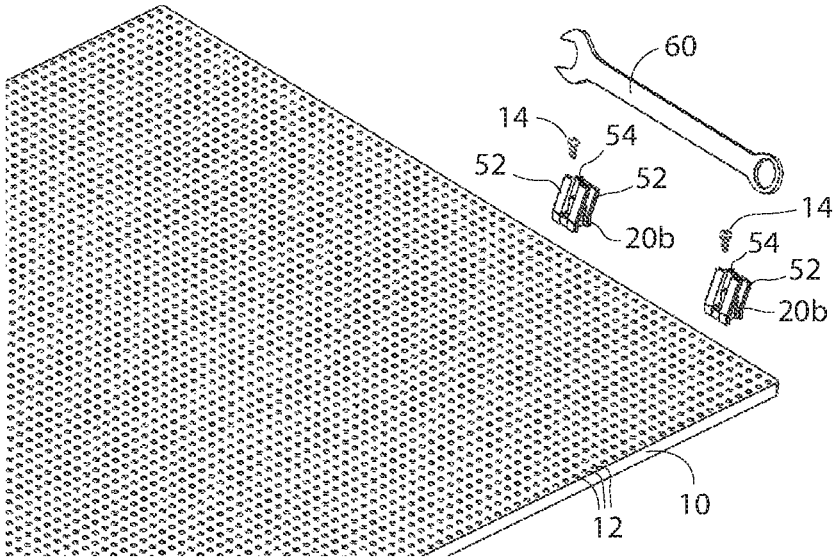
FIG. 6A is an exploded view of part of the tool organization board with exemplary first split-wall holders for securing a combination wrench, according to an embodiment of the present invention.
Figure 6B:
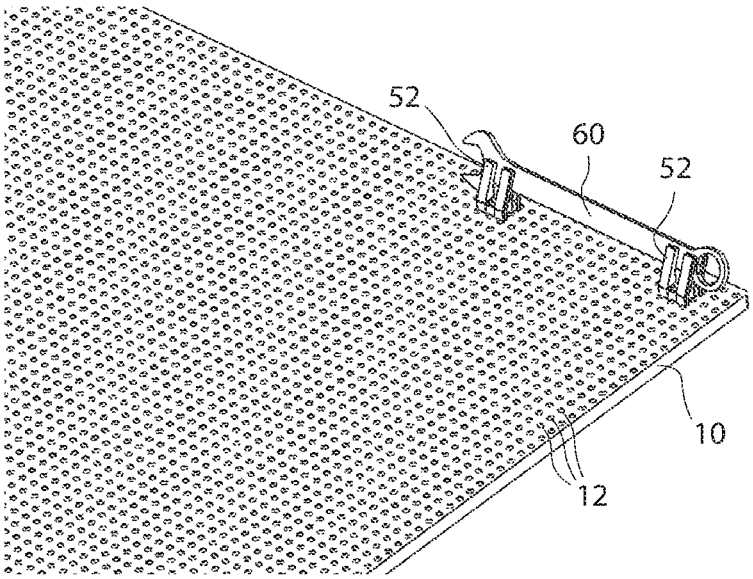
FIG. 6B is a perspective view of the combination wrench secured to the tool organization board with the exemplary first split-wall holders of FIG. 6A.
Figure 6C:
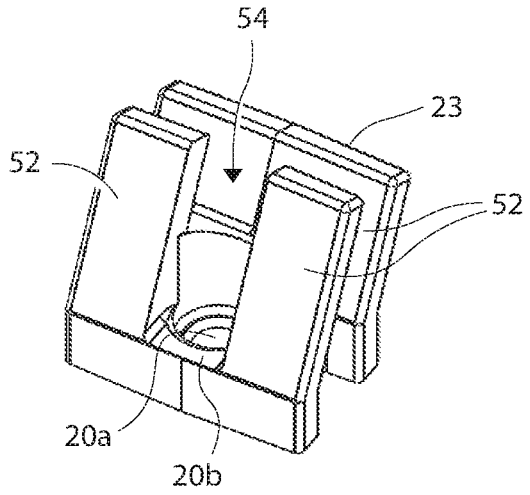
FIG. 6C is a perspective view of the exemplary first split-wall holder of FIG. 6A.
Figure 6D:
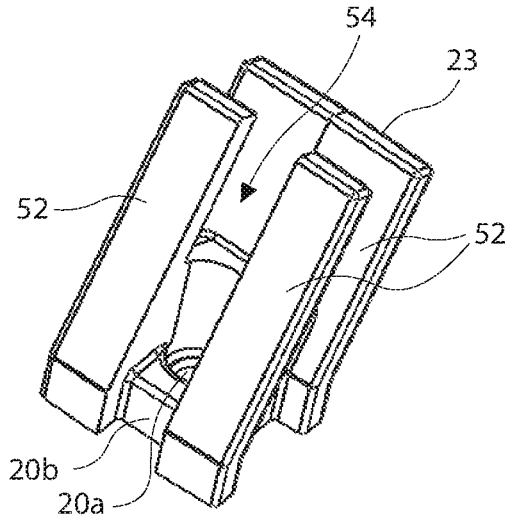
FIG. 6D is a perspective view of another exemplary first split-wall holder of FIG. 6A.
Figure 8A:
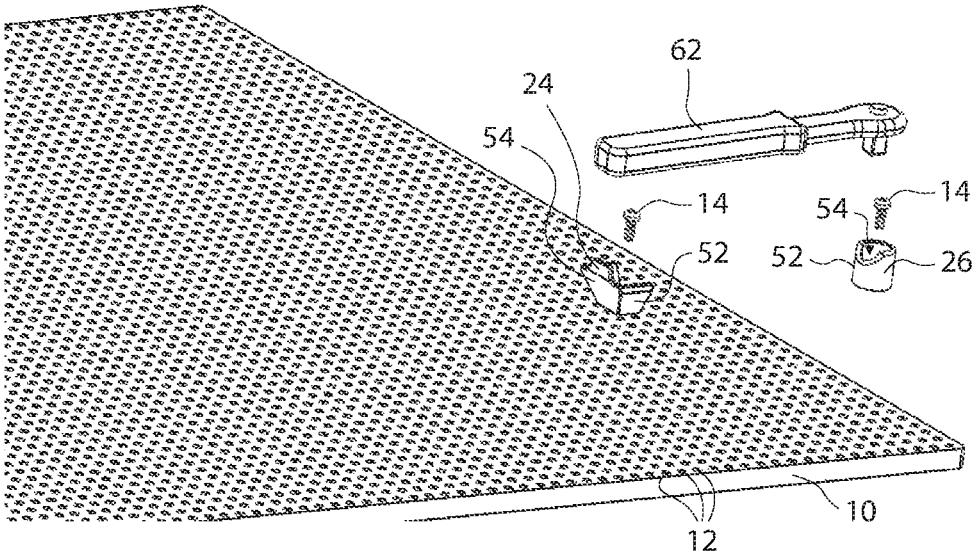
FIG. 8A is an exploded view of part of the tool organization board with an exemplary angled-wall second holder and third holder for securing a socket wrench.
Figure 8B:
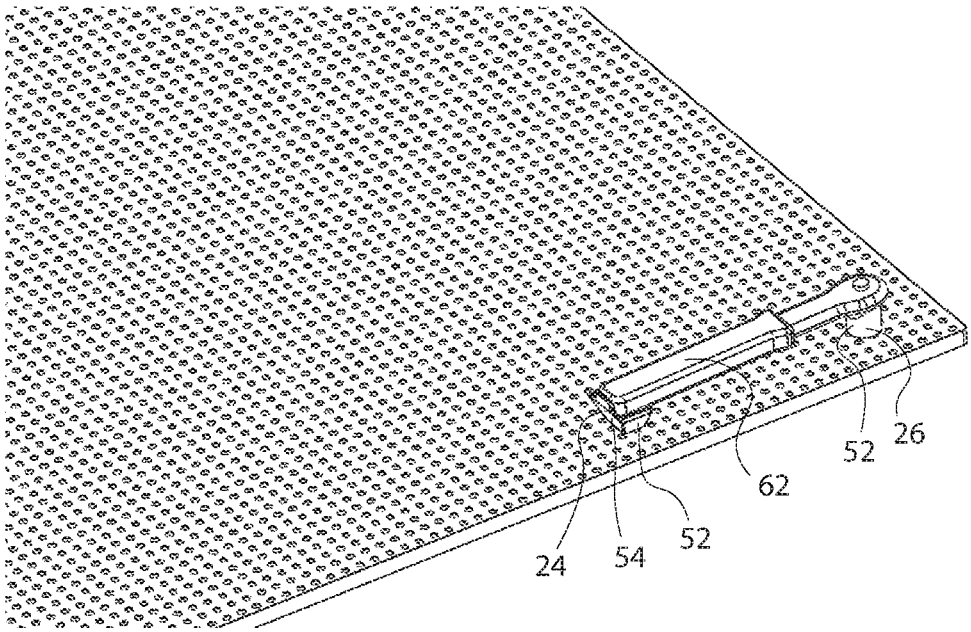
FIG. 8B is a perspective view of the socket wrench secured to the tool organization board with the exemplary angled-wall second holder and third holder of FIG. 8A.
Figure 8C:
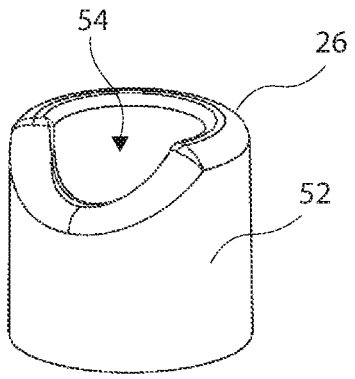
FIG. 8C is a perspective view of the exemplary third holder of FIG. 8A.
Figure 8D:
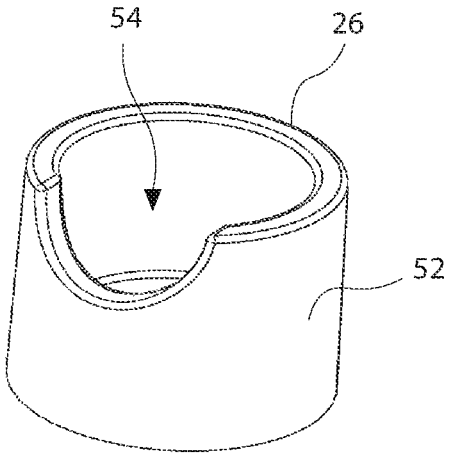
FIG. 8D is a perspective view of another exemplary third holder as described in FIG. 8A.

In another embodiment, the second holder 24 may have walls that extend upward generally orthogonally from the bottom portion 20*b* or may extend upward at an outward angle as shown, for example, in FIGS. 8A and 8B. This outward angle can allows for greater flexibility to receive tools of different lengths. Further, the top portion 50 may have a generally flat edge as shown in FIGS. 6D, 9A, and 9B, an indentation in the rim as shown in FIG. 7B, or a protrusion or extension as shown in FIGS. 7A-8B or any other variation to accommodate various tools.

Figure 9B:
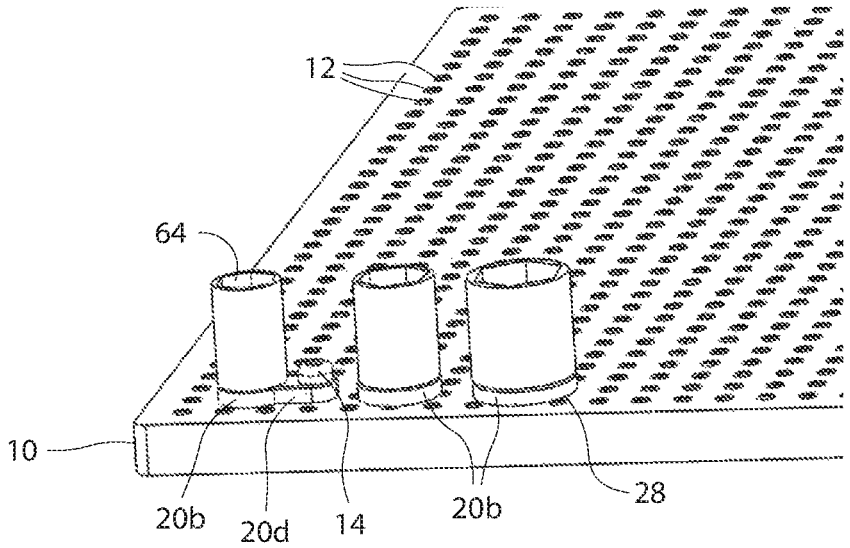
FIG. 9B is a perspective view of each socket secured to the tool organization board with the exemplary fourth holders of FIG. 9A, according to an embodiment of the present invention.
Figure 10A:
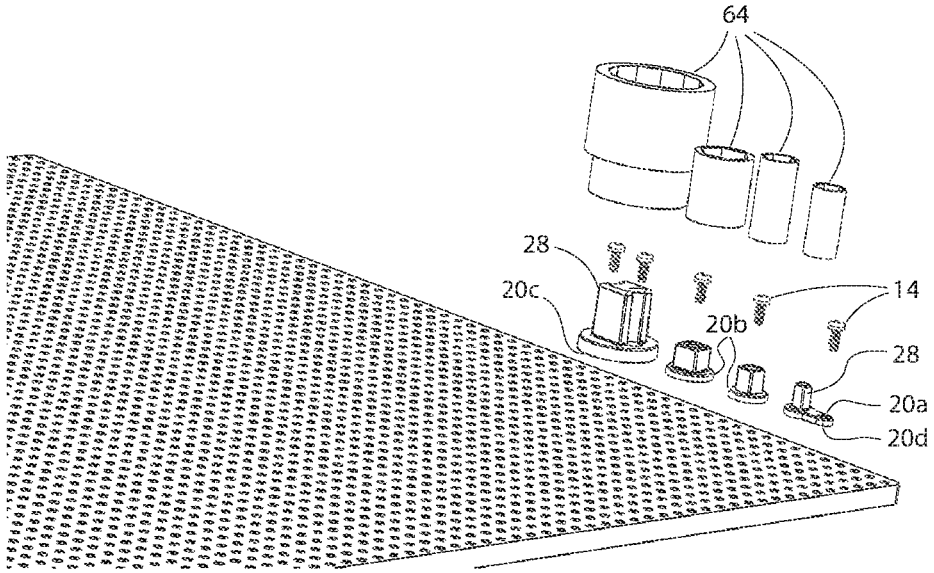
FIG. 10A is an exploded view of part of the tool organization board with further exemplary fourth holders for securing a socket, according to an embodiment of the present invention.
Figure 10B:
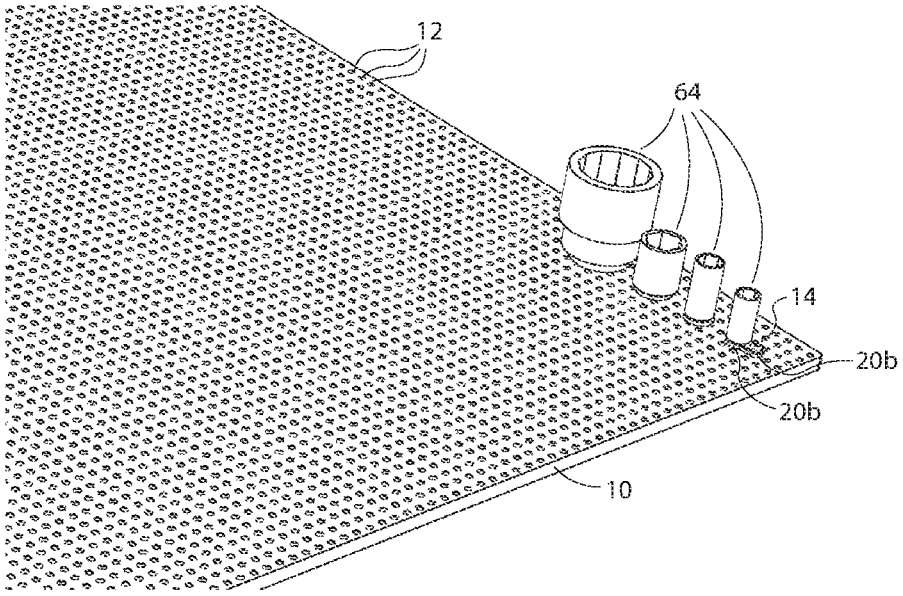
FIG. 10B is a perspective view of each socket secured to the tool organization board with the exemplary fourth holders of FIG. 10A, according to an embodiment of the present invention.

Also, a fourth holder 28 as shown in FIGS. 9A and 9B may be provided for receiving tools such as sockets 64 for use with socket wrenches 62. The fourth holder 28 has a wall 52 that is a protrusion 29 extending upward from bottom portion 20*b*. This protrusion 29 may be smaller across than the outer circular diameter of the bottom of the fourth holder 28 as shown in the accompanying figures. However, it may also be sized similarly or differently relative to the bottom portion 20*b*. Additionally, the protrusion 29 may have an outer perimeter shape to accommodate the socket. For example, the sockets 64 have a recess for receiving the central protrusion 29 of the fourth holder 28 to securely hold in place the sockets 64 onto the fourth holder 28 and consequently, the board 10. Accordingly, the protrusion 29 as shown has a quadrilateral perimeter to receive the, for example, interior hexagonal shape of the socket 64. Any other suitable perimeter shape, such as a circular perimeter for the protrusion 29 that permits adding or removing the socket 64 is also possible.

Additionally, the protrusion 29 may be hollow or solid. For example, in one variant, the protrusion 29 may be hollow or have a recess 54 to accommodate the hole 20*a* that is generally centered on the bottom portion 20*b* of the holder 28. In another variant, the hole 20*a* may extend through the lip 20*d* of the bottom portion as shown. In the latter instance, the protrusion 29 may be solid or hollow. A hollow protrusion may provide for a reduced weight but is not necessary. While the centered hole 20*a* may provide for multiple holders to be more closely positioned, the hole 20*a* through the lip 20*d* as shown may be desired in the cases of smaller holders to accommodate smaller sockets 64. That is, the screw 14 as shown may not fit through the recess 54 of the protrusion 29, requiring a lip 20*d* through which to extend. Accordingly, as shown in FIG. 9A, each variant of the holder 28 has a hole 20*a* for receiving a screw 14. FIG. 9B shows the socket 64 secured to the board 10 using the fourth holder 28, where the screw 14 is threadedly engaged into the holes 12 of the board 10 to secure the fourth holder 28 to the board 10.

While not shown, the protrusion extending from the bottom portion may simply be more than one wall, for example, two opposing walls having a recess therebetween, where the walls are for receiving the socket 64 so that the socket 64 fits around the walls. These walls may be angled inward toward the recess for ease of adding or removing the socket. Other embodiments are also envisioned.

Figure 11B:
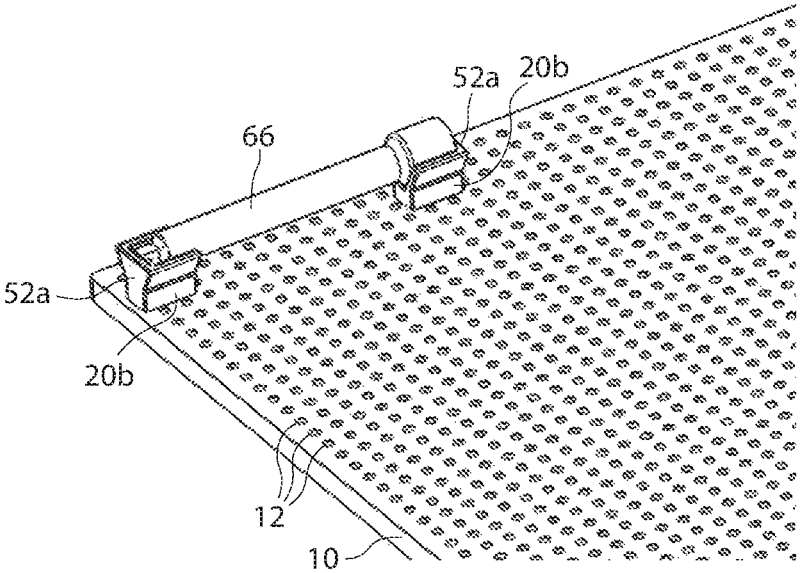
FIG. 11B is a perspective view of the extension bar secured to the tool organization board with the exemplary fifth holders of FIG. 11A, according to an embodiment of the present invention.
Figure 12A:
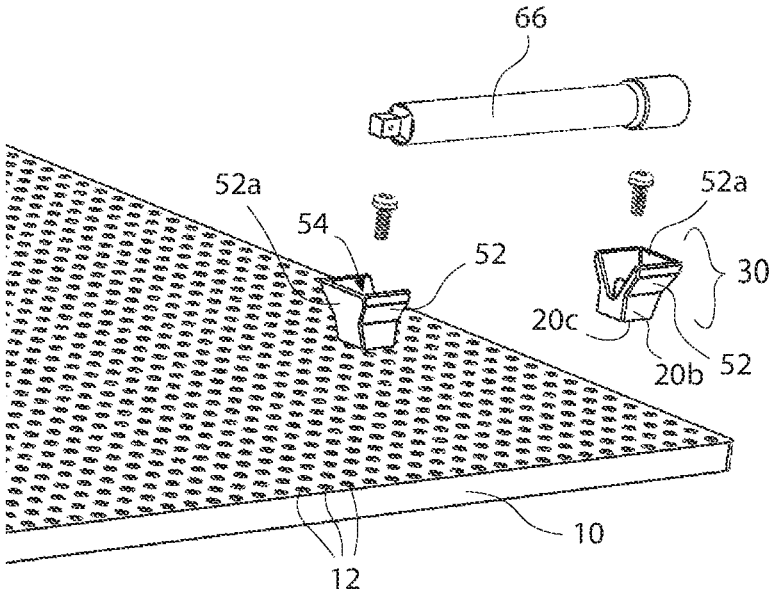
FIG. 12A is an exploded view of part of the tool organization board with exemplary angled-wall fifth holders for securing an extension bar, according to an embodiment of the present invention.
Figure 12B:
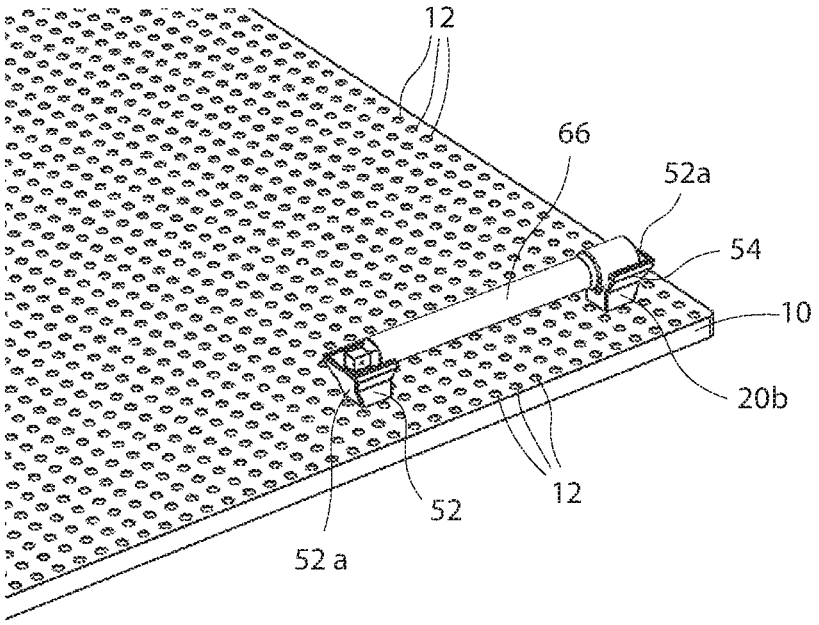
FIG. 12B is a perspective view of the extension bar secured to the tool organization board with the exemplary angled-wall fifth holders of FIG. 11A, according to an embodiment of the present invention.

A fifth holder 30 as shown in FIGS. 11A and 11B is provided for receiving tools such as extension bars 66. Similar to the second holder 24, the fifth holder 30 has walls 52 extending from the bottom portion 20*b* and a recess 54 for receiving the end handle portion of the extension bar 66. Also, one of the walls forms a rear wall 52*a* that joins the opposing walls 52. Thus, there are three walls that extend from the bottom portion 20*b*. The top portion 50 having the recess 50 of the fifth holder 30 is sized to receive the ends of extension bar 66 and other similarly shaped tools, for example those having a rectangular perimeter. As seen in FIG. 11A, the walls 52, 52*a* of the fifth holder 30 may extend upward at a 90 degree angle or may extend outwardly at angle greater than 90 degrees. Other shapes of the fifth holder 30 may be utilized to secure the extension bars 66. As shown in FIGS. 11A and 11B, the rear wall 52*a* is generally Y shaped to provide a narrower width at the bottom portion 20*b* than at the top portion 50 and to accommodate the remaining adjoining walls 52. In another embodiment, as shown in FIGS. 12A and 12B, the rear wall may be angled outwardly to increase the distance that can be created between two holders such as the fifth holders 30 and provide greater flexibility in holding different tool lengths.

As shown in FIG. 11A, the fifth holder 30 has a hole 20*a* in the bottom portion 20*b* for receiving a screw 14. FIG. 11B shows the extension bar 66 secured to the board 10 using two of the fifth holders 30, where each of the two screws 14 is threadedly engaged into its respective of the plurality of holes 12 of the board 10 to secure the two fifth holders 30 to the board 10.

Figure 13B:
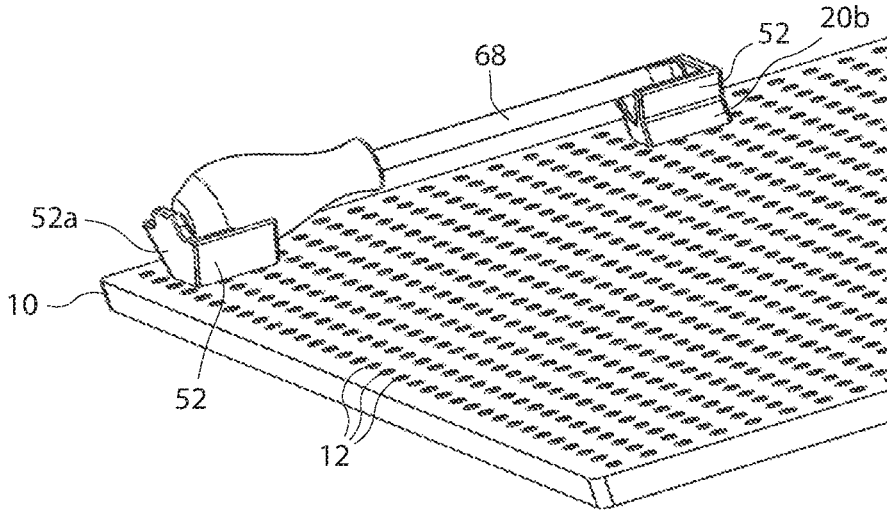
FIG. 13B is a perspective view of the screwdriver secured to the tool organization board with the exemplary holders of FIG. 13A, according to an embodiment of the present invention.
Figure 14A:
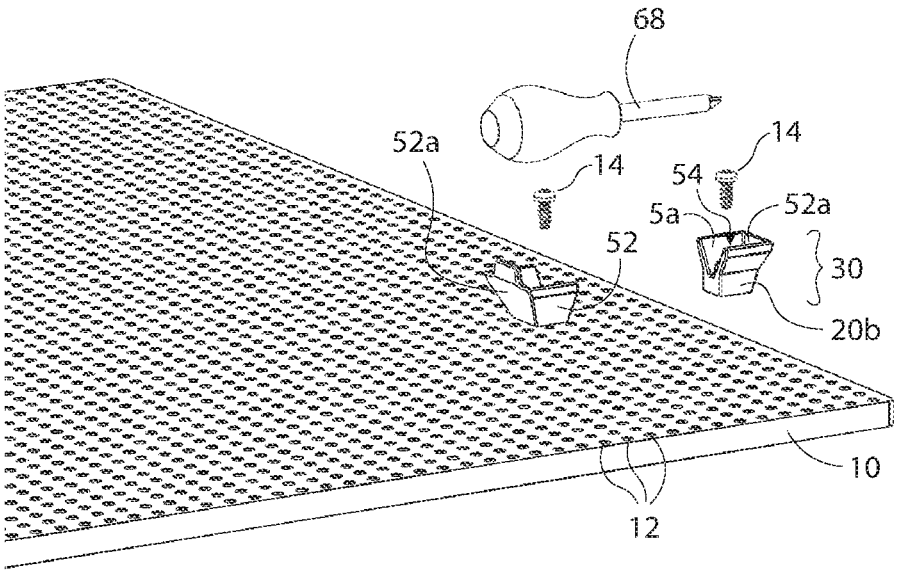
FIG. 14A is an exploded view of part of the tool organization board with exemplary angled-wall second and fifth holders for securing a screwdriver, according to an embodiment of the present invention.
Figure 14B:
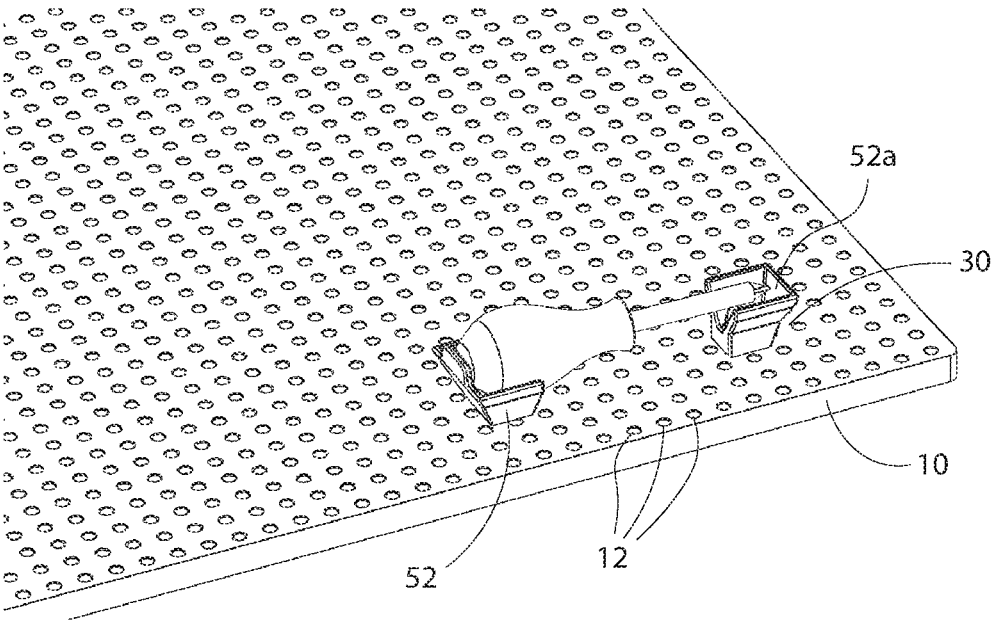
FIG. 14B is a perspective view of the screwdriver secured to the tool organization board with the exemplary angled-wall holders of FIG. 14A, according to an embodiment of the present invention.

As well, the previously described holders alone or in combination may be used for securing other types of tools not described above. For example, as shown in FIGS. 13A and 13B, the second holder 24 and the fifth holder 30 and their variants as shown in FIGS. 14A and 14B may be used in combination for securing a screwdriver 68 to the board 10. Particularly, the second holder 24 is used to receive the handle end of the screwdriver 68 and the fifth holder 30 is used to receive the tip end of the screwdriver. As well, efficient use of the space on the board 10 may be achieved by placing holders 20 that with walls 52 in an alternating fashion such that the walls 52 with a narrower bottom than top are adjacent the walls 52 with a wider bottom than top. Particularly, as shown in FIG. 2, adjacent screwdrivers 68 may be arranged in opposing positions to one another (e.g. the handle end of a first screwdriver is next to the tip end of the adjacent second screwdriver) to utilize the space on the board 10.

Figure 15A:
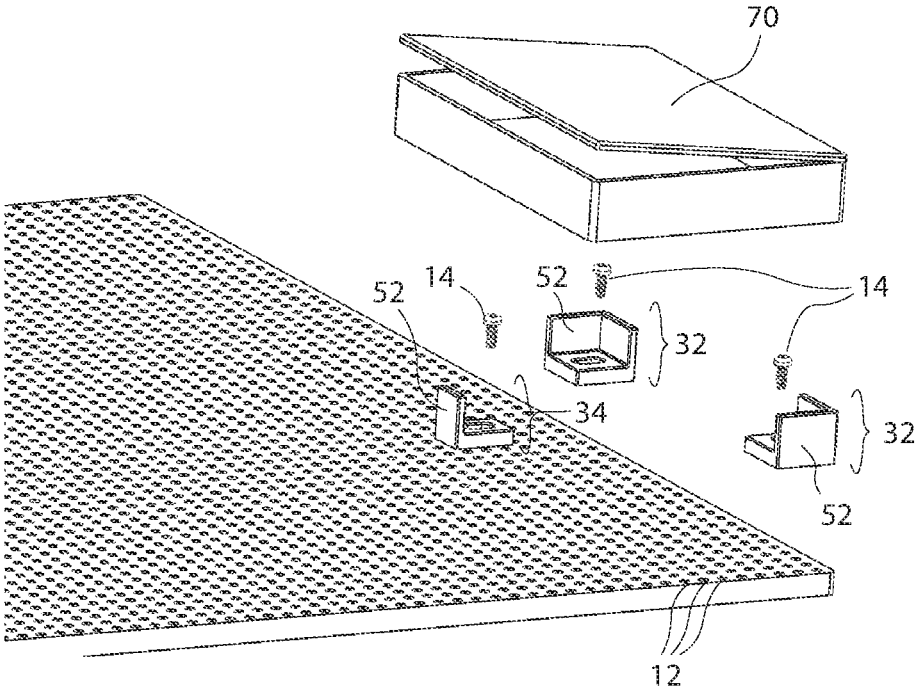
FIG. 15A is an exploded view of part of the tool organization board with exemplary corner holders and L-holders for securing a box, according to an embodiment of the present invention.
Figure 15B:
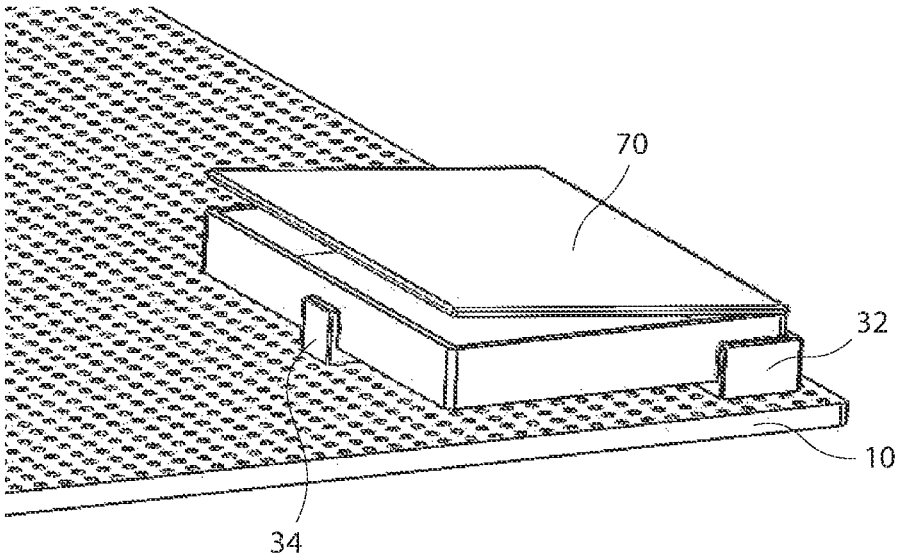
FIG. 15B is a perspective view of the box secured to the tool organization board with the exemplary corner holders and L-holders of FIG. 15A, according to an embodiment of the present invention.
Figure 16A:
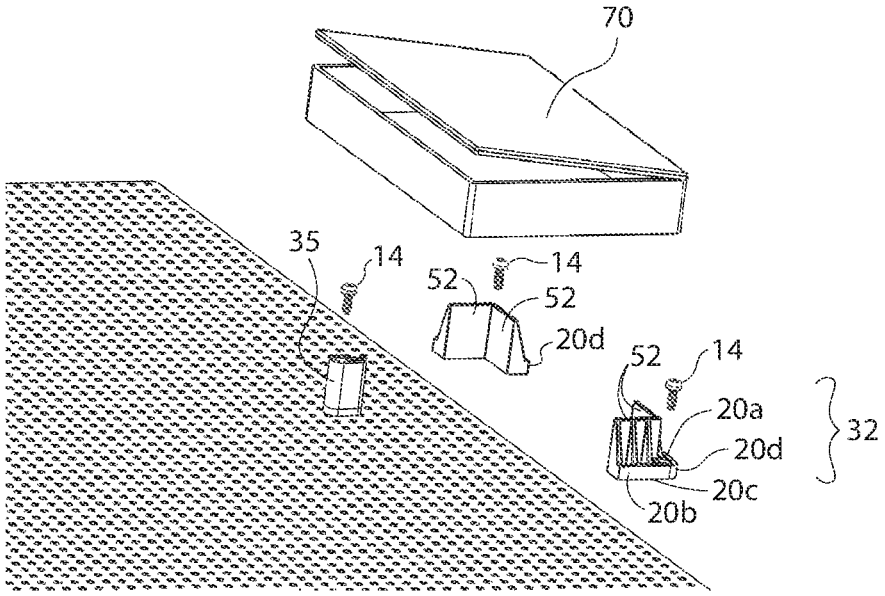
FIG. 16A is an exploded view of part of the tool organization board with exemplary corner holders having a lip and exemplary adjustable cam holders for securing a box, according to an embodiment of the present invention.

As shown in FIGS. 15A and 15B, another type of holder includes a corner holder 32, which has two connected walls 52 extending from the bottom portion 20*b* to create a recess 50. The two connected walls 52 may be orthogonally joined as shown so as to create a corner for receiving, for example, a container having orthogonal edges. Alternatively, the connected walls 52 may be angled inwardly or outwardly to accommodate containers of various perimeter shapes.

Additionally, the bottom portion 20*b* may extend inward so as to provide a surface on which the tool, such as container 70 rests. In this instance, the hole 20*a* extends through the inward bottom portion 20*b*. Therefore, the screw 14 is placed through the hole 20*a*. Also, the bottom portion 20*b* may be generally square as shown, or rectangular, triangular or any other shape not shown so that it provides a corresponding surface on which the tool may be held. For example, the bottom portion 20*b* may be flat as shown to accommodate a flat container 70 as shown.

Figure 16B:
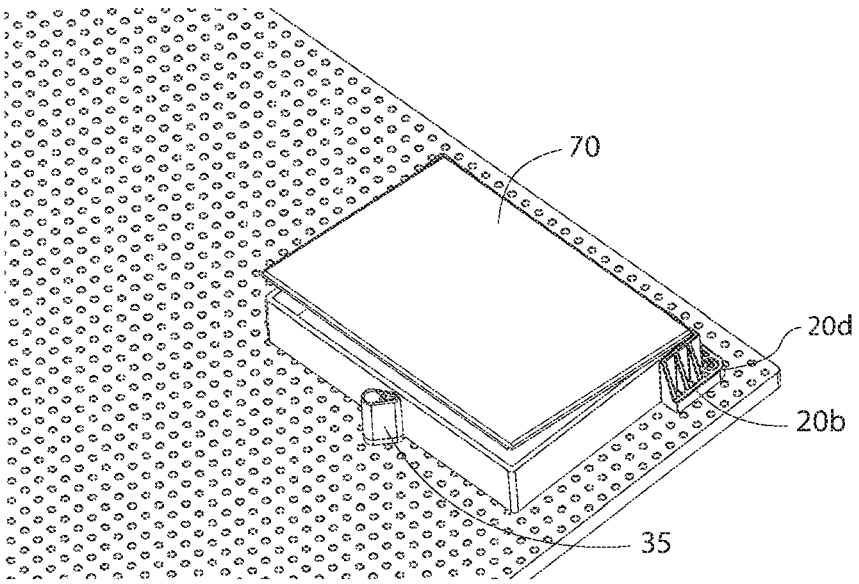
FIG. 16B is an exploded view of part of the tool organization board with exemplary corner holders having a lip and exemplary adjustable cam holders for securing a box, according to an embodiment of the present invention.

Alternatively, as shown in FIGS. 16A and 16B, the bottom portion 20*b* may extend outward from the two connecting walls so as to provide a lip 20*d* through which the hole 20*a* extends. In this instance, the adjacent or adjoining walls 52 receive the tool or container 70 along with the board 10 directly.

In another embodiment, as shown in FIGS. 15A and 15B, there may be an L-shaped holder 34 having a wall 52 extend from a bottom portion 20*b* to form an L-shaped component. A combination of the above as shown in FIGS. 15A-16B may be useful, for example, to the combination of these holders 32 and 34 may be used to receive a rectangular box or container that contains tools. For example, tools or components may be sold as a group of tools, such as in a rectangular shaped container. In this instance, the entire container may be secured to the board so that it does not move around in the tool chest drawer. This provides the benefit of inserting and taking out the entire container out of the tool chest drawer in a single step, rather than securing each tool or component to the board 10. As shown in FIGS. 15A and 15B, two of the corner holders 32 are used to secure a container 70 to the board by surrounding two of the outer perimeter corners of the container 70. As well, as shown in FIGS. 15A and 15B one of the L-shaped holder 34 is used to secure the opposite side of the container 70 secured by the two corner holders 32. The container 70 may be secured to the board 10 using a different combination of the corner holders 32 and L-shaped holders 34, for example with four corner holders 32, two corner holders 32 at diagonal corners of the container 70, two L-shaped holders 34 on opposing sides of the container 70 and the like.

In still another embodiment, as shown in FIGS. 16A and 16B, an adjustable cam holder 35 may be used. The adjustable cam holder has a bottom portion 20*b* and at least one wall 52 extending from the bottom portion 20*b*. Multiple walls 52 may extend from the bottom portion 20*b* and a hole 20*a* extends through the bottom portion 20*b*. The adjustable cam holder 35 may be rotated so that a wall 52 of the cam holder 35 rests on the edge of the tool, such as container 70. This, in turn, allows greater flexibility to hold different sized bins or containers 70.

Figure 17A:
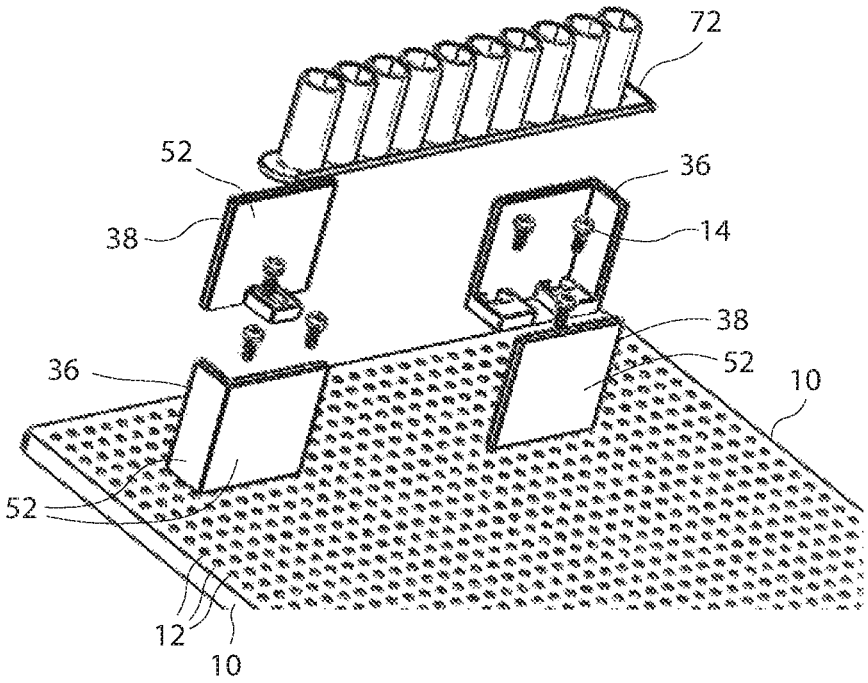
FIG. 17A is an exploded view of part of the tool organization board with exemplary single-wall and two-wall holders for securing a set of sockets, according to an embodiment of the present invention.
Figure 17B:
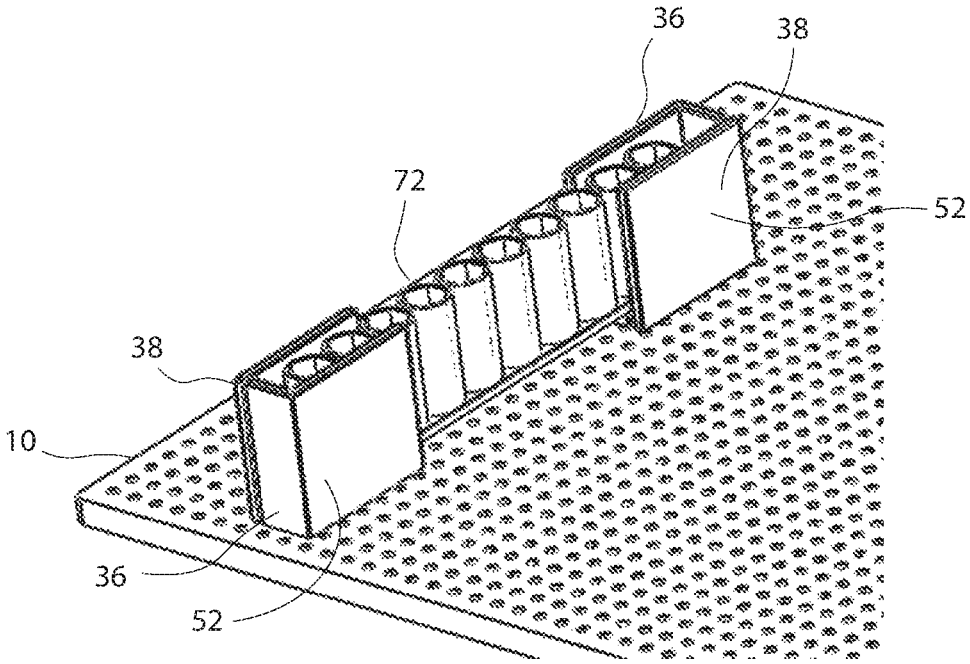
FIG. 17B is a perspective view of the set of sockets secured to the tool organization board with the exemplary single-wall and two-wall holders of FIG. 17A, according to an embodiment of the present invention.

In another embodiment, a further type of holder includes walls or rails that may be secured to the board 10. Similar to the corner holders, a single wall holder 38 and a two-wall holder 36 (FIGS. 17A and 17B) may be used to create a separate compartment on the board 10 upon which a group of tools or components may be contained. As shown in FIGS. 17A and 17B, the single wall holder 38 has a bottom portion 20*b* and one wall 52 generally perpendicular to and partially connected to the bottom portion 38. The two-wall holder 36 has two connected walls 52 extending from the bottom portion 20*b* in a generally perpendicular fashion so as to create an edge. The two connected walls 52 of the two-wall holder 36 may be of different sizes and shapes relative to each other. As illustrated in FIGS. 17A and 17B, the single wall holder 38 and the two-wall holder 36 may be used together to form a compartment having three walls 52 with a recess 54 therebetween to receive tools, for example, to receive a set of sockets 72.

As shown in FIG. 17A, the single wall holder 38 has a hole 20*a* and the two-wall holder 36 has two holes 20*a* for receiving screws 14. Alternatively, the two-wall holder 36 may have one hole 20*a* for receiving screw 14. FIG. 17B shows the set of sockets 72 secured to the board 10 using a combination of the single wall holder 38 and the two-wall holder 36 at each end of the set of sockets 72, where each of the screws 14 is threadedly engaged into respective of the plurality of holes 12 of the board 10 to secure the single wall holders 38 and the two-wall holders 36 to the board 10. Other combinations of the single wall holder 38 and the two-wall holder 36 may be used to create larger compartments and compartments of different shapes than those shown in FIGS. 17A and 17B.

In still another embodiment, similar to the second holder 24, a V holder 39 is provided having a bottom portion 20*b* with a hole dimensioned to align with the plurality of holes on the board 10. Walls 52 extend from the bottom portion 20*b*

The various types of holders described herein may be used for other types of tools commonly found in tool chest drawers, such as for example hammers and various types of pliers. As well, the various types of holders described herein may be used on the board 10 in various combinations to provide a large number of unique arrangements. Also, each type of holder described herein may be available in different sizes, providing more flexibility in the type of tools that may be secured to the board 10 and various custom tool organizational arrangements that are available. Additionally, the tool holders may be color coded so as to differentiate between different measurement units. For example, the tool holders may be colored a certain color to indicate holder used to hold standard/SAE tools or a different color to hold metric tools. For example, the standard tool holders may be red whereas the metric tool holders may be blue.

The scope of the claims should not be limited by the embodiments set forth in the examples, but should be given the broadest interpretation consistent with the description as a whole.

Parts List

| | | | |
|---|---|---|---|
| 10 | board | 32 | corner holder |
| 11a | length of board | 34 | L-shaped holder |
| 11b | width of board | 35 | adjustable cam holder |
| 11c | height of board | 36 | two-wall holder |
| 12 | plurality of holes | 38 | single wall holder |
| 14 | screws | 40 | tool chest drawer |
| 20 | plurality of holders | 50 | top portion |
| 20a | hole in holder | 52 | wall |
| 20b | bottom portion | 52a | rear wall |
| 20c | flat bottom surface | 54 | recess |
| 20d | lip | 60 | combination wrench |
| 21 | outer body of holder | 62 | socket wrench |
| 22 | inner portion of holder | 64 | sockets |
| 23 | first holder | 66 | extension bars |
| 24 | second holder | 68 | screwdriver |
| 26 | third holder | 70 | storage box |
| 28 | fourth holder | 72 | set of sockets |
| 29 | protrusion | 74 | pliers |
| 30 | fifth holder | | |

What is claimed is:

1. A system for organizing tools, the system comprising:

a board having a plurality of holes extending into the top surface but not extending through the board, the plurality of holes being arranged in rows and columns at predetermined intervals, wherein the holes in each row and column are aligned with holes in adjacent rows and columns;

one or more holders having a bottom portion, the bottom portion of each holder having at least one hole dimensioned to align with the plurality of holes on the board; and one or more threaded fasteners for securing the one or more holders to the board, wherein each of the one or more fasteners passes through a respective one of the at least one hole in the holder and into and threadedly engaging a respective one of the plurality of holes on the board, wherein the one or more holders has a top portion for receiving an end portion of a tool for securing the tool to the board, wherein the top portion has at least one wall extending vertically from the bottom portion for receiving the end portion of a tool to the board, wherein the at least one hole extends through a lip that forms part of the bottom portion and extends outward from the bottom portion; and wherein a concentric inner and outer wall define a rim.

2. The system of claim 1, wherein the concentric inner and outer walls defining the rim are of non-similar geometric shapes.

3. The system of claim 1, wherein the top portion has at least two walls extending vertically from the bottom portion and has a recess between the walls for securing the end portion of a tool to the board, and wherein the at least two walls are angled outwardly in a parallel fashion to accommodate varying tool lengths.

4. The system of claim 1, wherein the top portion has at least two walls extending vertically from the bottom portion and has a recess between the walls for securing the end portion of a tool to the board, and wherein the at least two walls extending from the bottom portion are connected at one edge to create a corner for receiving a tool or container.

5. The system of claim 1, wherein the at least one wall is rotatable relative to the bottom portion to form an adjustable cam holder.

6. A system of organizing tools, the system comprising:

a board having a plurality of holes extending into the top surface but not extending through the board, the plurality of holes being arranged in rows and columns at predetermined intervals, wherein the holes in each row and column are aligned with holes in adjacent rows and columns;

one or more holders having a bottom portion, the bottom portion of each holder having at least one hole dimensioned to align with the plurality of holes on the board;

the one or more holders having a top portion for receiving an end portion of a tool for securing the tool to the board; and one or more threaded fasteners for securing the one or more holders to the board, wherein each of the one or more fasteners passes through a respective one of the at least one hole in the holder and into and threadedly engaging a respective one of the plurality of holes on the board, wherein the at least one hole extends through a lip that forms part of the bottom portion and extends outward from the bottom portion.

7. The system of claim 6, wherein the at least one hole that extends through the lip that forms part of the bottom portion extends in a parallel fashion to the top surface of the board.

* * * * *